US005166018A

United States Patent [19]

Iino et al.

[11] Patent Number: 5,166,018

[45] Date of Patent: Nov. 24, 1992

[54] PHOTOSENSITIVE MEMBER WITH HYDROGEN-CONTAINING CARBON LAYER

[75] Inventors: Shuji Iino, Hirakata; Hideo Hotomi, Suita; Izumi Osawa, Ikeda; Mitsutoshi Nakamura, Osaka, all of Japan

[73] Assignee: Minolta Camera Kabushiki Kaisha, Osaka, Japan

[21] Appl. No.: 259,413

[22] Filed: Oct. 19, 1988

Related U.S. Application Data

[63] Continuation of Ser. No. 905,549, Sep. 10, 1986, abandoned.

[30] Foreign Application Priority Data

Sep. 13, 1985 [JP] Japan ..... 60-204154
Sep. 19, 1985 [JP] Japan ..... 60-207894
May 17, 1986 [JP] Japan ..... 60-112847

[51] Int. Cl.[5] ..... G03G 5/047

[52] U.S. Cl. ..... 430/58; 430/128; 430/132

[58] Field of Search ..... 430/58, 62, 63, 64, 430/84, 95, 136

[56] References Cited

U.S. PATENT DOCUMENTS

| | | | |
|---|---|---|---|
| 3,956,525 | 5/1976 | Yasuba | 427/41 |
| 4,365,013 | 12/1982 | Ishioka et al. | 430/57 |
| 4,366,208 | 12/1982 | Akai et al. | 428/421 |
| 4,376,688 | 3/1983 | Ceasar et al. | 204/192 |
| 4,394,426 | 7/1983 | Shimizu et al. | 430/65 |
| 4,409,308 | 10/1983 | Shimizu et al. | 430/60 |
| 4,416,755 | 11/1983 | Caesar et al. | 204/192 |
| 4,451,546 | 5/1984 | Kawamura et al. | 430/69 |
| 4,452,874 | 6/1984 | Ogawa et al. | 430/57 |
| 4,465,750 | 8/1984 | Ogawa et al. | 430/57 |
| 4,466,380 | 8/1984 | Jansen et al. | 118/712 |
| 4,471,042 | 9/1984 | Komatzu et al. | 430/64 |
| 4,490,450 | 12/1984 | Shimizu et al. | 430/57 |
| 4,491,626 | 1/1985 | Kawamura et al. | 430/69 |
| 4,495,262 | 1/1985 | Matsuzaki et al. | 430/58 |
| 4,510,224 | 4/1985 | Yamazaki et al. | 430/58 |
| 4,513,022 | 4/1985 | Jansen et al. | 427/39 |
| 4,513,073 | 4/1985 | Jeffrey, III et al. | 430/65 |
| 4,518,670 | 5/1985 | Matsuzaki et al. | 430/58 |

(List continued on next page.)

FOREIGN PATENT DOCUMENTS

| | | |
|---|---|---|
| 194329 | 7/1988 | European Pat. Off. . |
| 3525908 | 6/1990 | Fed. Rep. of Germany . |
| 50-30526 | 4/1975 | Japan . |
| 51-46130 | 3/1976 | Japan . |
| 54-115134 | 7/1979 | Japan . |
| 55-86169 | 7/1980 | Japan . |
| 56-000751 | 2/1981 | Japan . |
| 56-62254 | 5/1981 | Japan . |
| 56-60447 | 6/1981 | Japan . |
| 150753 | 11/1981 | Japan . |

(List continued on next page.)

OTHER PUBLICATIONS

Journal of Applied Polymer Science, vol. 17, pp. 885–892 (1973) Formation of an Amorphous Powder During the Polymerization of Ethylene in a Radio-Frequency Discharge.

"Properties of Diamond-Like Carbon Films", *Thin Sold Films*, vol. 119, pp. 121–126, 1984.

"Electronic Properties of Subsitutionally Doped Amorphous Si and Ge", *Philisophical Magazine*, vol. 33, No. 6, pp. 935–949, 1976.

(List continued on next page.)

*Primary Examiner*—Roland Martin
*Attorney, Agent, or Firm*—Burns, Doane, Swecker & Mathis

[57] ABSTRACT

The present invention provides a photosensitive member comprising a carrier transporting layer of hydrogen-containing carbon, which is excellent in a charge transporting property, a chargeability, a rigidity and resistances to corona, acid, moisture and heat as well as an adhesive property of a charge transporting layer with a charge generating layer and a substrate.

15 Claims, 3 Drawing Sheets

U.S. PATENT DOCUMENTS

| | | | |
|---|---|---|---|
| 4,522,905 | 6/1985 | Ogawa et al. | 430/60 |
| 4,544,617 | 10/1985 | Mort et al. | 430/58 |
| 4,557,987 | 12/1985 | Shirai et al. | 430/58 |
| 4,559,289 | 12/1985 | Sunagawa et al. | 430/66 |
| 4,579,801 | 4/1986 | Yashiki | 430/65 |
| 4,592,982 | 6/1986 | Saitoh et al. | 430/57 |
| 4,598,032 | 7/1986 | Saitoh et al. | 430/58 |
| 4,634,648 | 1/1987 | Jansen et al. | 430/84 |
| 4,675,265 | 6/1987 | Kazama et al. | 430/57 |
| 4,686,164 | 8/1987 | Osawa et al. | 430/63 |
| 4,741,982 | 5/1988 | Iino et al. | 430/58 |
| 4,755,444 | 7/1988 | Karakida et al. | 430/66 |

FOREIGN PATENT DOCUMENTS

| | | | |
|---|---|---|---|
| 115552 | 10/1982 | Japan . | |
| 88753 | 7/1983 | Japan . | |
| 154850 | 9/1983 | Japan . | |
| 171038 | 10/1983 | Japan . | |
| 58-205555 | 10/1983 | Japan . | |
| 59-28161 | 2/1984 | Japan . | |
| 59-38753 | 3/1984 | Japan . | |
| 136742 | 8/1984 | Japan . | |
| 214859 | 11/1984 | Japan . | |
| 137977 | 4/1985 | Japan | 430/65 |
| 60-249155 | 5/1985 | Japan . | |
| 61761 | 6/1985 | Japan . | |
| 63531 | 6/1985 | Japan . | |
| 63541 | 6/1985 | Japan . | |
| 60-125846 | 9/1985 | Japan . | |
| 60-130747 | 9/1985 | Japan . | |
| 61-94056 | 5/1986 | Japan . | |
| 61-243460 | 12/1986 | Japan . | |
| 1174171 | 12/1969 | United Kingdom . | |

OTHER PUBLICATIONS

"Photosensitive Materials for Electron Photography—OPC vs. Inorganics", *Nikkei New Materials*, Dec. 15, 1986.

"A Review of Recent Advances in Plasma Enginerring", *Review of Recent Advances*, Mar. 29, 1979.

"A C-NMR Investigation of Plasma Polymerized Ethane, Ethylene, and Acetylene" by A. Dilks, S. Kaplan, and A. Vanlaeken, Xerox Webster Research Center, Xerox Square, W-114, Rochester, N.Y. 14644.

PHOTOSENSITIVE MEMBER WITH HYDROGEN-CONTAINING CARBON LAYER

This application is a continuation, of application Ser. No. 905,549, filed Sep. 10, 1986, now aban.

BACKGROUND OF THE INVENTION

The present invention relates to a photosensitive member, particularly to a photosensitive member comprising a hydrogen-containing carbon layer as a charge transporting layer.

Electrophotography has been remarkably developed since the invention of the image-transfer type. Various new materials have also been developed and have been practised.

The main materials for conventional electrophotosensitive members include inorganic compounds such as non-crystalline selenium, selenium-arsenic, selenium-tellurium, zinc oxide, amorphous silicon and the like, and organic compounds such as polyvinylcarbazole, metal phthalocyanine, dis-azo pigments, tris-azo pigments, perillene pigments, triphenylmethanes, triphenylamines, hydrazones, styryl compounds, pyrazolines, oxazoles, oxadiazoles and the like.

Structures of electrophotosensitive members include a single layer type using one of the above compounds, a binder type in which the above compounds are dispersed in a binder resin, and multilayer type carrier generating layers and carrier transporting layers.

All conventional materials for electrophotosensitive members, however, have defects, one of which is poisonous for humans. Additionally, in order to use these electrophotosensitive members in a copying machine, initial properties must be kept constant, when they are exposed to the serious copying conditions of charge, exposure, development, transference, erasing, cleaning and the like. Many organic compound are poor in durability, and have many unstable properties.

Recently, in order to improve the above problems amorphous silicon (referred to as a-Si hereinafter) formed by a plasma chemical vapor deposition (referred to as plasma CVD) has been applied to produce a photosensitive member.

A-Si photosensitive members have several excellent properties. But the relative dielectric constant ($\epsilon$) of a-Si is so large (about 12) that it essentially needs a thickness of at least 25 $\mu$m to gain a sufficient surface potential for a photosensitive member. In addition, in the production of an a-Si photosensitive member by plasma CVD a long production time is needed because of a slow deposition rate of an a-Si layer. The long deposition time makes it difficult to obtain a homogeneous a-Si layer with the result that image defects such as white spot noises are liable to occur at a high percentage. Further, the cost becomes expensive.

Though many attempts to improve the above defects have been made, it is unpreferable to make the layers thinner.

On the other hand, an a-Si photosensitive member has such additional defects as weak adhesive strength between a-Si layer and electroconductive substrate, and poor resistances to corona, circumstances and chemicals.

It has been proposed to use an organic polymeric layer which is produced by plasma polymerization (referred to as OPP layer hereinafter) and is arranged as an overcoat layer or an undercoat layer in order to solve the above problems. The former is proposed, for instance in U.S. Pat. No. 3,956,525, and the latter is done in Japanese Patent KOKAI No. 63541/1985.

It is known that an OPP layer can be produced from various kinds of organic compound such as ethylene gas, benzenes, aromatic silanes and the like (e.g. Journal of Applied Polymer Science Vol. 17, 885-892 (1973), by A. T. Bell et al.). However, the OPP layer produced by these conventional methods is restrictively used as an insulator. Therefore, the layer is considered as an insulating layer having an electrical resistance of about $10^{16}$ $\Omega$.cm as an ordinary polyethylene layer or at least similar to such a layer.

Recently, there is proposed a layer comprising diamond-like carbon in the semiconductor field. But charge transportability thereof has not been suggested at all.

U.S. Pat. No. 3,956,525 discloses a photosensitive member consisting of a substrate, a sensitizing layer, an organic photoconductive electrical insulator and a glow discharging polymer layer having a thickness of 0.1-1 $\mu$m in the above order. This polymer layer is provided to cover the surface, so as to stand up to wet development as an overcoat. Carrier transportability of the layer is not suggested.

Japanese Patent KOKAI No. 63541/1980 discloses a photosensitive member comprising an undercoat layer composed of a diamond-like carbon and having a thickness of 200 Å to 2 $\mu$m and an a-Si photoconductive layer formed on said undercoat layer. This undercoat layer is formed to improve adhesion of the a-Si layer to the substrate. The undercoat layer may be so thin that a charge moved through it by tunnel effect.

As mentioned above, photosensitive members have been proposed which comprises an undercoat layer or an overcoat layer composed of an electrically insulating OPP layer, a diamond-like layer and the like, but the transport of the charge is basically attributed to the tunnel effect and phenomena of dielectric breakdown.

The tunnel effect is caused due to the passage of electrons, when that the thickness of an insulating layer is very thin (generally at an Angstrom unit).

Dielectric breakdown phenomenon is where a small number of existing charge carriers are accelerated by an electric field to gain sufficient energy to be capable of ionizing atoms in the insulator, with the result that carrier increase by the ionization. This phenomena occurs at a high electric field (generally more than 100 V/$\mu$m).

In the case of a photosensitive member having laminated layers of an insulating layer and a semiconducting layer, charges generated in the semiconducting layer move through the layer under an electric field, but they can not pass through the insulating layer under a low electrical field. If the insulating layer is thin, it is ignored as a surface potential or it does not adversely affect properties of photosensitivity because of negligible development influence. Further, even if the charges are accumulated on the insulating layer by repeated use to give a higher potential, the potential in the electric field does not increase above a constant level (e.g. 100 V/$\mu$m) because of the dielectric breakdown.

For example, when an insulating layer comprising insulating materials capable of causing dielectric breakdown at 100 V/$\mu$m is formed at a thickness of 0.1 $\mu$m, the increase of the residual potential based on the repetition is only 10 V.

According to the above reasons, it has been understood that if a conventional insulating layer is used in a photosensitive member, the thickness of the layer has to be less than about 5 μm, or else the residual potential based on the insulating layer increases to more than 500 V causing an overlap of the copied image to occur.

SUMMARY OF THE INVENTION

The primary object of the present invention is to provide a photosensitive member which is free of the above-mentioned drawbacks, has excellent charge transportability and chargeability, and is capable of obtaining a good copy image.

The second object of present invention is to provide a photosensitive member with excellent in low residual potential and adhesion of a charge generating layer with a charge transporting layer.

Another object of the invention is to provide a photosensitive member capable of production at lower cost and within a short time.

Still another object of the invention is to provide a photosensitive member comprising a charge transporting layer which is excellent in corona resistance, acid resistance, humid resistance, heat resistance and rigidity.

These and other objects of the invention can be accomplished by providing a photosensitive member which comprises an electrically conductive substrate, a charge generating layer and a charge transporting layer comprising a hydrogen-containing carbon, and less than about 20000 ppm of elements of group IIIA or VA based on the amount of carbon and the elements of group IIIA or VA, said hydrogen being contained in an amount of about 0.1 to 67 atomic % based on the amount of all atoms contained in said charge transporting layer.

DETAILED DESCRIPTION OF THE INVENTION

Figure 1:
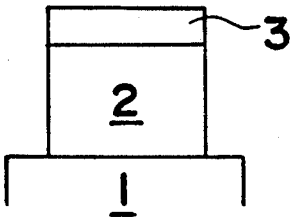
FIGS. 1–12 are schematic sectional views of photosensitive members of the present invention.

FIG. 1 shows an embodiment of a photosensitive member of the invention to illustrate the construction thereof. The photosensitive member comprises an electrically conductive substrate (1), a hydrogen-containing carbon layer (2) (referred to as the C:H layer hereinafter) which functions as a charge transporting layer, and a charge generating layer (3). Said C:H layer includes hydrogen in an amount of about 0.1 to 67 atomic % based on the amount of all atoms contained in said C:H layer, and elements of IIIA or VA group in an amount of less than about 20000 ppm based on the amount of carbon and elements of group IIIA or VA.

An electrophotosensitive member requires a dark resistance of not less than $10^9$ Ω.cm and a ratio of light-/dark resistance (i.e. gain) of at least $10^2$ to $10^4$, even in a functionally separating photosensitive member.

The photosensitive member of the present invention is constituted by the carrier generating layer (3) and the C:H layer (2), which functions as a carrier transporting layer.

The C:H layer (2) contains hydrogen at 0.1 to 67 atomic percent based on the amount of all atoms contained in the C:H layer (2), preferably 1 to 60 atomic percent, more preferably 30 to 60 atomic percent, and most preferably 40 to 58 atomic percent. A C:H layer having less than 0.1 atomic percent gives a dark resistance unsuitable for electrophotography, and more than 67 atomic percent will not give carrier transportability.

The C:H carbon layer of the present invention can be produced as an amorphous carbon or a diamond-like carbon according to the hydrogen content or the process for production. For the most part, an amorphous C:H layer is obtained, which is soft and of high resistance to electricity. However, when the layer having a hydrogen content of less than about 40 atomic percent is produced by the plasma CVD method, a diamond-like carbon layer can be obtained. Such a layer is harder, having a Vickers hardness of more than 2000 and has a resistance of more than $10^8$ Ω.cm.

Further, the C:H layer of the present invention can be produced as a polymer layer, for example, a polymer layer formed by a plasma polymerization.

Polymer layers formed by plasma polymerization show excellent charge transportability when combined with charge generating layers.

Hydrogen content of the C:H layer and the structure thereof can be determined by elemental analysis, IR analysis, $^1$H-NMR, $^{13}$C-NMR and the like.

A C:H layer of the present invention preferably has an optical energy gap (Egopt) of 1.5 to 3.0 eV, and a relative dielectric constant (ε) of 2.0 to 6.0.

A C:H layer having a smaller Egopt (less than 1.5 eV) forms many levels near the end of the bands, that is, at the lower end of the conduction band and the upper end of the filled band. Therefore, in this case the C:H layer is not always suitable as a charge transporting layer because of its smaller mobility of carriers and shorter carrier life. A C:H layer having a larger Egopt (more than 3.0 eV) has a tendency to make a barrier at the interface between the charge generating materials and the charge transporting materials which are ordinarily used for an electrophotosensitive member, so there are cases when the injection of carriers from the charge generating layer to the C:H layer and from the C:H layer to the charge generating layer cannot be achieved. As a result, excellent photosensitive properties cannot be obtained.

In the meanwhile, where the relative dielectric constant (ε) is larger than 6.0, charging capacity and sensitivity decrease. Increasing the thickness of the C:H layer has been considered in order to overcome these drawbacks, but the increase in thickness of C:H layer is not desirable for production purposes. If the relative dielectric constant is less than 2.0, the properties of the layer become similar to those of polyethylene so as to reduce the charge transportability.

The hydrogen contained in the C:H layer (2) as a charge transporting layer may be partially substituted by halogen, for instance, fluorine, chlorine, bromine and the like. Such layers have improved water repellancy and abrasion resistance due to the substitution.

The thickness of the C:H layer (2) as a charge transporting layer is preferably about 5–50 μm, more preferably 7–20 μ. The C:H layer having a thickness of less than 5 μm has low charging capacity, with the result that a sufficient contrast can not be obtained on a copied image. The thickness of more than 50 μm is not desirable for production. The C:H layer has an excellent light transparency, a high dark resistance and a high charge transportability. Even if the thickness of the layer exceeds 5 μm, carriers can be transported without trapping.

The C:H layer (2) of the present invention may be produced under ionized conditions by ion vapor deposition, a ion beam deposition and the like; under a plasma condition by direct current, high frequency, microwave plasma methods and the like; and through a neutral particle by reduced compression CVD, vacuum vapor deposition, sputtering methods, optical CVD and the like or a combination thereof. However, for instance, in the case that charge generating layers are produced by a high frequency plasma or CVD, it is desirable to produce C:H layers by the same method in the aspect of reduction of apparatus costs and labor saving..

Carbon source for C:H layer may include $C_2H_2$, $C_2H_4$, $C_2H_{67}$, $C_3C_6$, $CH_4$, $C_4H_{10}$, $C_4H_6$, $C_4H_8$, $C_3H_8$, $CH_3CCH$, $C_8H_8$, $C_{10}H_{16}$, and the like.

The carrier gas may preferably include $H_2$, Ar, Ne, He and the like.

In order to obtain a hydrogen-containing carbon layer having a hydrogen content of not more than 40 atomic percent in a plasma polymerization, a saturated hydrocarbon diluted with hydrogen is preferably used. Examples of the most preferable saturated hydrocarbons are methane, ethane, propane or butane. The plasma polymerization is carried out under low pressure and a high voltage. Production of such a hydrogen-containing carbon layer having a low hydrogen content may be produced by an ion beam method as well as by plasma polymerization. Such a method is described in J. Appl. Phys. 52,(10) Oct. 1981 (6151-6157). Of course, a sputtering method may be used.

As a C:H layer having a low hydrogen content has excellent rubbing resistance and moisture resistance, a charge transporting layer comprising such a C:H layer may be arranged on the surface side. If arranged on substrate side it prevents charge from injecting from the substrate, and prevents plasma damage when the charge generating layer is formed thereon by high frequency plasma.

C:H layer may contain hydrogen at a content of more than 40 atomic percent. Such a C:H layer having a high hydrogen content may be produced by a plasma discharge or an ion beam using unsaturated hydrocarbons such as ethylene, propylene, acetylene and the like diluted with hydrogen. The pressure of the reactor at the plasma discharge is preferably higher than that for the production of the C:H layer having a low hydrogen content but the voltage is preferably lower than that of the C:H layer having a low hydrogen content.

If a C:H layer having a high hydrogen content is used as a charge transporting layer and is to be combined with an a-Si charge generating layer, a photosensitive member can be obtained, which has superior charging capacity and sensitivity than a photosensitive member produced from a-Si alone. Further, a C:H layer arranged on the substrate side acts as a charge injection preventing layer. Such a layer also improves rigidity of the surface, rubbing resistance, moisture resistance, corona resistance and adhesion.

A C:H layer having a comparably higher hydrogen content (i.e. more than 55 atomic percent) is referred to as the plasma polymerization layer (referred to as a PP C:H layer hereinafter). A PP C:H layer has a highly cross-linked net structure different from the aforementioned C:H layer. Therefore, the PP C:H layer has high density, high rigidity, high chemical resistance and heat resistance. Further, this PP C:H layer traps free radicals so as to have a higher dielectric loss than the aforementioned C:H layer. A polymerized polyethylene layer by plasma deposition is a typical plasma polymerization layer with a ratio of hydrogen atoms to a carbon atom of about 2.7/2, but does not have a melting point corresponding to the melting point of ordinary polyethylene, but has a heat resistance of more than 330° C.

According to the present invention an element belonging to group III A or VA of the Periodic Table is incorporated into C:H layer (2) in order to control the charging properties of charge transporting layers.

Reverse bias effect may be achieved by making the substrate side P-type and the surface side N-type when the photosensitive member is positively charged, and by making the substrate side N-type and the surface side P-type when it is negative charged. In the above manner various effects such as improvement of charging capacity, decrease of the reduction rate of the surface potential in darkness and improvement of the sensitivity of a photosensitive member can be obtained. In a photosensitive member formed by laminating C:H charge transporting layers and charge generating layers, elements of group VA or IIIA may be incorporated into the charge transporting layer or, if desired, into the charge generating layer such that when positively charged the surface side becomes comparatively N-type and the substrate side becomes comparatively P-type whichever the carrier generating layer is arranged on the surface side and the charge transporting layer is on the substrate side or vice versa.

The polarity may be controlled by gradually increasing an element of IIIA or VA group in the surface side or the substrate side within a layer, or a single charge transporting C:H layer containing an element of group IIIA or VA may be arranged on the surface side or the substrate side. Alternatively, if necessary, plural C:H layers with different concentrations of an element of group IIIA or VA may be arranged at conjunction areas so as to form depletion layers.

With reference to FIG. 1, if the photosensitive member is positively charged and then exposed to a light image, charge carriers generate in the charge generating layer (3), and electrons neutralize the surface charge. The holes are transported to the substrate (1) by the excellent charge transportability of the C:H layer (2). The C:H charge transporting layer of the invention is adjusted to be P-type by incorporating an element from group IIIA. A hole can be easily transported to the substrate so that the sensitivity is improved and the injection of negative charge from the substrate is prevented. The charge generating layer(3) is preferably N-type. For instance a-Si is suitable because it is an intrinsic weak N-type. A-si also be incorporated with an element from group VA.

Elements from group IIIA used to form a P-type layer may include B, Al, Ga, In and the like, especially B. The surface layer may be controlled to a relatively higher N-type by incorporating elements of group VA such as P, into the a-Si charge generating layer. In this case the C:H layer may be controlled to be a P-type. When the photosensitive member used has a negative charge, the C:H layer (2) is controlled to be a N-type by incorporating P therein. When a-Si is used as the charge generating layer, B may be incorporated therein.

FIGS. 2 to 12 show other embodiment of photosensitive members of the invention to illustrate the construction thereof.

Figure 2:
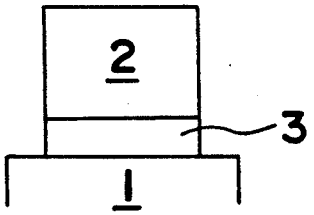

FIG. 2 illustrates a photosensitive member containing a C:H layer (2) as the outermost layer. When this member is used with a positive charge, polarity of the C:H layer (2) may be controlled to be a N-type in comparison to the charge generating layer (3) with an element from group VA so as to facilitate mobility of electrons. When the photosensitive member is used with a negative polarity, an outermost C:H layer may be controlled reversely by incorporating B, for example.

Figure 3:
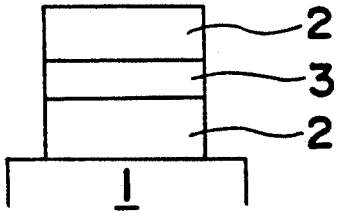

The photosensitive member of FIG. 3 is an embodiment containing C:H layer (2) on the upper and lower sides of the charge generating layer (3). When it is used at a positive polarity, it is desirable to control the upper C:H layer (2) be an N-type in comparison with the charge generating layer (3) so as to facilitate mobility of electrons, whereas the lower C:H layer (2) is controlled to be a P-type.

Figure 4:
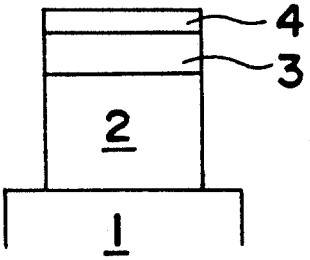
Figure 5:
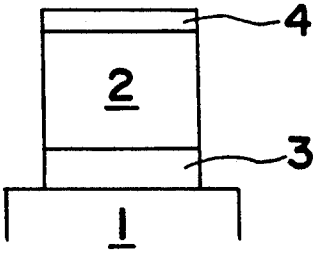
Figure 6:
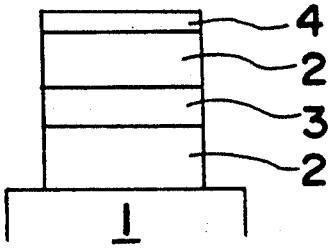

Photosensitive members illustrated in FIGS. 4–6 have an overcoat layer (4) on photosensitive members of FIGS. 1–3. The overcoat layers act as a surface protective layer for a charge generating layer (3) or a C:H charge transporting layer (2), and improve the initial surface potential. The thickness of the overcoat layer is preferably about 0.01–5 μm. As a surface protective layer, any materials which are usually used therefor may be used. In the present invention the protective layer may preferably be formed by organic plasma polymerization for production reasons. The overcoat layer may be a C:H layer according to the present invention. Elements of groups IIIA or VA may be doped into the surface protective layer (4), if necessary.

Figure 7:
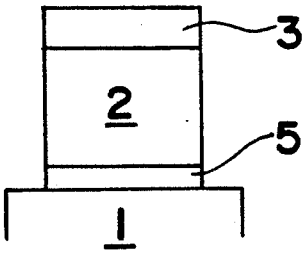
Figure 8:
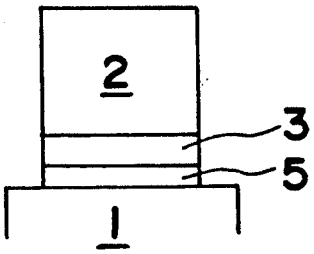
Figure 9:
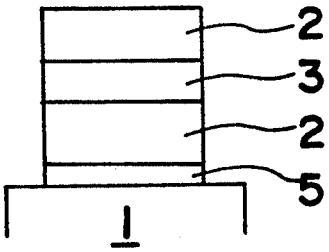
Figure 10:
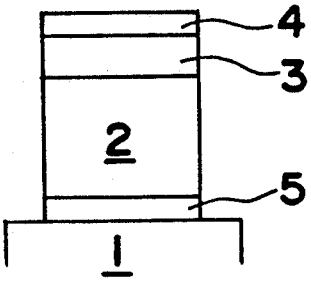
Figure 11:
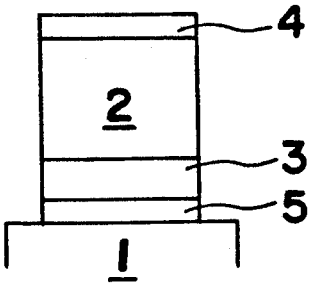
Figure 12:
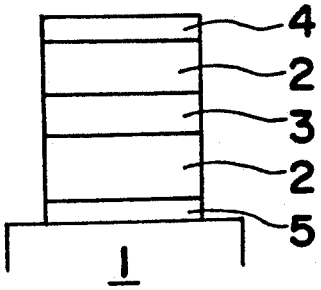

The photosensitive members of FIGS. 7–9 are examples in which a C:H layer used as a carrier transporting layer is applied to the substrate (1) to make it function as an undercoat layer, a barrier layer and/or an adhesive layer. As an undercoat layer, of course, conventional materials may be used. In such a case the undercoat layer may be preferably formed by organic plasma polymerization. The barrier layer inhibits injection of charge from the substrate and transports charges generated in the charge generating layer (3) to the substrate. Therefore, it is desirable to incorporate elements of group IIIA when it is used at a positive polarity and elements of group VA at a negative polarity. The thickness of the barrier layer is preferably about 0.01–5 μm. An overcoat layer (4) may be applied on photosensitive members of FIGS. 7–9 as illustrated in FIGS. 10–12.

In order to incorporate elements of group IIIA into the C:H layer, suitable gaseous compounds containing these elements are deposited with hydrocarbon gas under an ionized state or a plasma state. Alternatively, the C:H layer may be exposed to gas containing elements of group IIIA to be doped.

Compounds containing boron may include $B(OC_2H_5)_3$, $B_2H_6$, $BCl_3$, $BBr_3$, $BF_3$ and the like.

Compounds containing aluminum may include $Al(Oi\text{-}C_3H_7)_3$, $(CH_3)_3Al$, $(C_2H_5)_3AL$, $(i\text{-}C_4H_8)_3Al$, $AlCl_3$ and the like.

Compounds containing gallium may include $Ga(Oi\text{-}C_3H_7)_3$, $(CH_3)_3Ga$, $(C_2H_5)_3Ga$, $GaCl_3$, $GaBr_3$ and the like.

Compounds containing indium may include $In(Oi\text{-}C_3H_7)_3$, $(C_2H_5)_3In$ and the like.

The content of elements of group IIIA may be preferably not more than 20000 ppm, more preferably about 3–1000 ppm.

Elements the VA group used for polarity control may be P, As, and Sb, especially P. The elements of VA group may be incorporated into the C:H layer in the same manner as the IIIA group.

Compounds containing elements of the VA group useable in the present invention may include $PO(OCH_3)_3$, $(C_2H_5)_3P$, $PH_3$, $POCl_3$ and the like as a compound containing P; $AsH_3$, $AsCl_3$, $AsBr_3$ and the like as a compound containing As; $Sb(OC_2H_5)_3$, $SbCl_3$, $SbH_3$ and the like as a compound containing Sb.

The content of the elements of group VA is preferably not more than 20000 ppm, more preferably about 1–1000 ppm.

The properties of the charge generating layer of the photosensitive members may be controlled by incorporating another additional elements.

Such additional elements include Si, Ge, and/or Sn. They are incorporated such that the content thereof is less than 10 atm.% based on the carbon and such additional elements. When so modified the carriers are more easily injected from the charge generating layer to the charge transporting layer so that reduction of the residual potential and memory and increases in sensitivity are achieved. The adhesion of the charge transporting layer with the Al substrate and the charge generating layer is improved. Further, a rubbing resistance and the water repelling properties are improved.

If the content of an element above is more than 10 atm.%, that is, the content of carbon in a C:H charge transporting layer is less than 90 atm.%, defects such as the following are caused period; When the carbon content is 30–90 atm.%, dark resistance increases but the transporting efficiency becomes lower. When the carbon content is 5–30 atm.%, the charge transporting efficiency is high, but the dielectric constant depends on the incorporated element, for instance, silicon itself, and so the object of this invention can not be achieved. In the above case, there is no difference between a conventional a-Si photosensitive member and that of the invention in chargeability, deposition rate for production, and cost. However, when the carbon content is 90–100 atm.%, a C:H layer has an excellent charge transporting ability and the phase boundary barriers between the charge generating layer and the charge transporting layer decreases, so sensitivity is improved. Furthermore, chargeability is highly improved because the dielectric constant is small.

In order to incorporate the above elements, the same method as mentioned in injection of an element of group IIIA may be applied. In case of Si, compounds such as $Si_2H_6$, $(C_2H_5)_3SiH$, $SiF_4$, $SiH_2Cl_2$, $SiCl_4$, $Si(OCH_3)_4$, $Si(OC_2H_5)_4$, $Si(OC_3H_7)$ and the like are used. In case of doping Ge, compounds such as $GeH_4$, $GeCl_4$, $Ge(OC_2H_4)_4$, $Ge(C_2H_5)_4$ and the like are used. In case of injection of Sn, compounds such as $(CH_3)_4Sn$, $(C_2H_5)Sn$, $SnCl_4$ and the like are used.

There are cases when the charge transporting layers are colored to, for instance, yellow, blue, brown or so according to a production conditions thereof or by impurity contamination. In the embodiments of FIGS. 2, 3, 4, 5, 6, 8, 9, 10, 11 and 12 such a phenomena may be utilized to prevent injurious light from transmitting to the charge generating layers.

Phase boundary barriers between the charge generating layers and charge transporting layers may be made smaller by incorporating Si or Ge into the latter to control the band gap. In embodiments of FIG. 1 a large quantity of Ge (more than 10 atomic %) may be incorporated into layers near the substrate, by which reflection of surplus light can be prevented, so that interference fringes and blurredness can be prevented.

Nitrogen, oxygen, sulfur and/or various kinds of metals may be additionally incorporated into the C:H charge transporting layers, or a part of hydrogen of the C:H charge transporting layer may be substituted with halogen.

As a nitrogen source $N_2$, $NH_3$, $N_2O$, NO, $NO_2$, $C_2H_5NH_2$, HCN, $(CH_3)_3N$, $CH_3NH_2$ and the like may be used in general, and addition thereof can make the phase boundary barrier smaller between charge generating layers and charge transporting layers.

As an oxygen source $O_2$, $O_3$, $N_2O$, NO, CO, $CO_2$, $CH_3COCH_3$, $CH_3CHO$ and the like are exemplified. The incorporation of these compounds improves charging capacity, and can accelerate the plasma CVD layer formation rate.

As a sulfur source $CS_2$, $(C_2H_5)_2S$, $H_2S$, $SF_6$, $SO_2$ and the like are exemplified. The incorporation of sulfur is effective to prevent light absorption and light interference. In addition, a rate of the layer formation can be made faster by sulfur doping sulfur.

Additional metals incorporated into C:H charge transporting layers include: Ba: $Ba(OC_2H_5)_3$, Ca: $(Ca(OC_2H_5)_3$, Fe: $Fe(Oi\text{-}C_3H_7)_3$, $(C_2H_5)_{2Fe}$, $Fe(CO)_5$, Hf: $Hf(Oi\text{-}C_3H_7)_4$, K: $KOi\text{-}C_3H_7$, Li: $Li(Oi\text{-}C_3H_7)$, La: $La(Oi\text{-}C_3H_7)_4$, Mg: $Mg(OC_2H_5)_2$, $(C_2H_5)_2Mg$, Na: $Na(Oi\text{-}C_3H_7)$, Nb: $Nb(OC_2H_5)_5$, Sr: $Sr(OCH_3)_2$, Ti: $Ti(Oi\text{-}C_3H_7)_4$, $Ti(C_1H_9)_4$, $TiCl_4$, Te: $H_2Te$, Se: $H_2Se$, Ta: $Ta(OC_2H_5)_5$, V: $VO(OC_2H_5)_3$, Y: $Y(Oi\text{-}C_3H_7)_3$, Zn: $Zn(OC_2H_5)_2$, $(CH_3)_2Zn$, $(C_2H_5)_2Zn$, Zr: $Zr(Oi\text{-}C_3H_7)_4$, Cd: $(CH_3)_2Cd$, Co: $Co_2(CO)_8$, Cr: $Cr(CO)_6$, Mn: $Mn(CO_{10})$, Mo: $Mo(CO)_6$, $MoF_6$, $MoCl_6$, W: $W(CO)_6$, $WF_6$, $WCl_6$.

By the substitution of hydrogen in the C:H charge transporting layer with halogen, water repellance, rubbing resistance and light transmittance can be improved. Especially when substitution is of fluorine, —CF, $—CF_2$, $—CF_3$, and the like the refractive index (n) becomes smaller (eg. 1.39), so that reflection also becomes smaller.

If the C:H charge transporting layer obtained according to the present invention is contacted with the atmosphere after argon treatment, carbonyl groups are formed on the surface of the layer to be activated. The group of $—CF_2$ is changed to —CF.

The incorporation of a small amount of Si or Ge makes a C:H charge transporting layer having a hard surface, excellent abrasion resistance and excellent water repellancy. Further, the incorporation of both Si and Ge makes it easy to move the charge carriers from the charge generating layer to the C:H layer to thereby cause favorable effects such as reduction of residual potential and increase of sensitivity.

As a source of carbon and halogen $C_2H_5$, Cl, $C_2H_3Cl$, $CH_3Cl$, $CH_3Br$, $COCl_2$, $CCl_2F_2$, $CHClF_2$, $CF_4$, HCl, $Cl_2$, $F_2$ and the like are included.

Charge generating layers which may be used in the present invention are not restrictive. Any charge generating layers may be used. Examples of these layers may be a-Si layers which may contain various kinds of element to change the properties of the layers such as C, 0, S, N, P, B, Ge, halogen and the like, and may be of multilayer structures; Se layers; Se-As layers; Se-Te layers; CdS layers; layers made by binding inorganic or organic charge generating compounds with resinous materials; and the like. Such inorganic compounds may include zinc oxide and the like, and such organic compounds may include bis-azo compounds, triarylmethane dye, thiazine dye, oxazine dye, xanthene dye, cyanine dye, styryl dye, pyryliums, azo compounds, quinacridones, indigos, perillenes, polycyclic quinones, bisbezimidazoles, Indanthrenes, squaliliums, phthalocyanines and the like.

Other compounds, so far as these can absorb light to generate carriers at a high efficiency, can be used. Charge generating layers may be formed by any method.

The charge generating layers of the present invention may be arranged anywhere as described before, such as an outmost layer, an innermost layer or a middle layer. The thickness of charge generating layers may be designed such that 90% of 555 nm light can generally be. absorbed, which is dependent on the kind of materials, especially spectrophotoabsorption properties, sources of light exposure, objects and the like. In the case of a-Si:H, the thickness of the layer is generally about 0.1–1 μm.

The photosensitive member of the present invention contains carrier generating layers and carrier transporting layers. Therefore, there are at least two processes needed to produce the member When a-Si layers are formed using, for example, an apparatus for glow discharge decomposition, plasma polymerization can be carried out in the same apparatus. Therefore, C:H charge transporting layers, surface protective layers, barrier layers and the like are preferably produced by the plasma polymerization.

The thickness of a C:H transporting layer is preferably thicker from a standpoint of the charge retention, but preferably thinner from a standpoint of productivity or charge transporting ability. A C:H transporting layer used for an electrophotography is preferably 5–50 μm in thickness.

Figure 13:
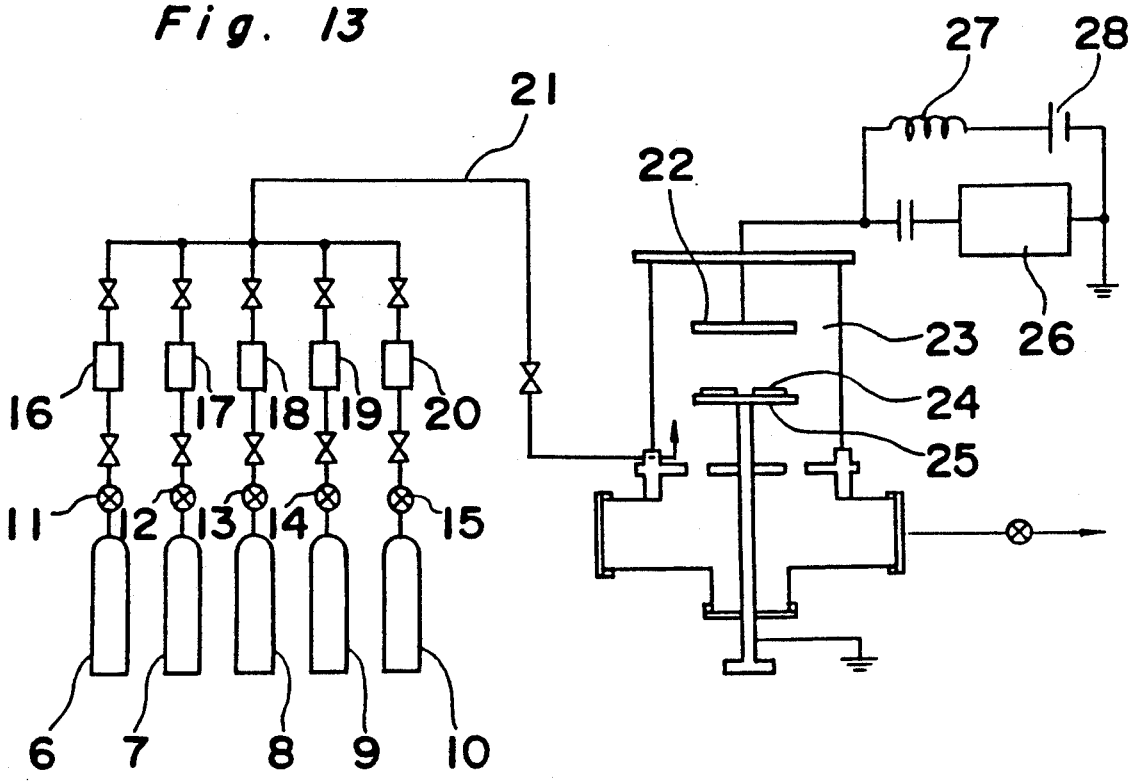
FIGS. 13–15 are examples of apparatus for production of photosensitive member of the present invention.
Figure 14:
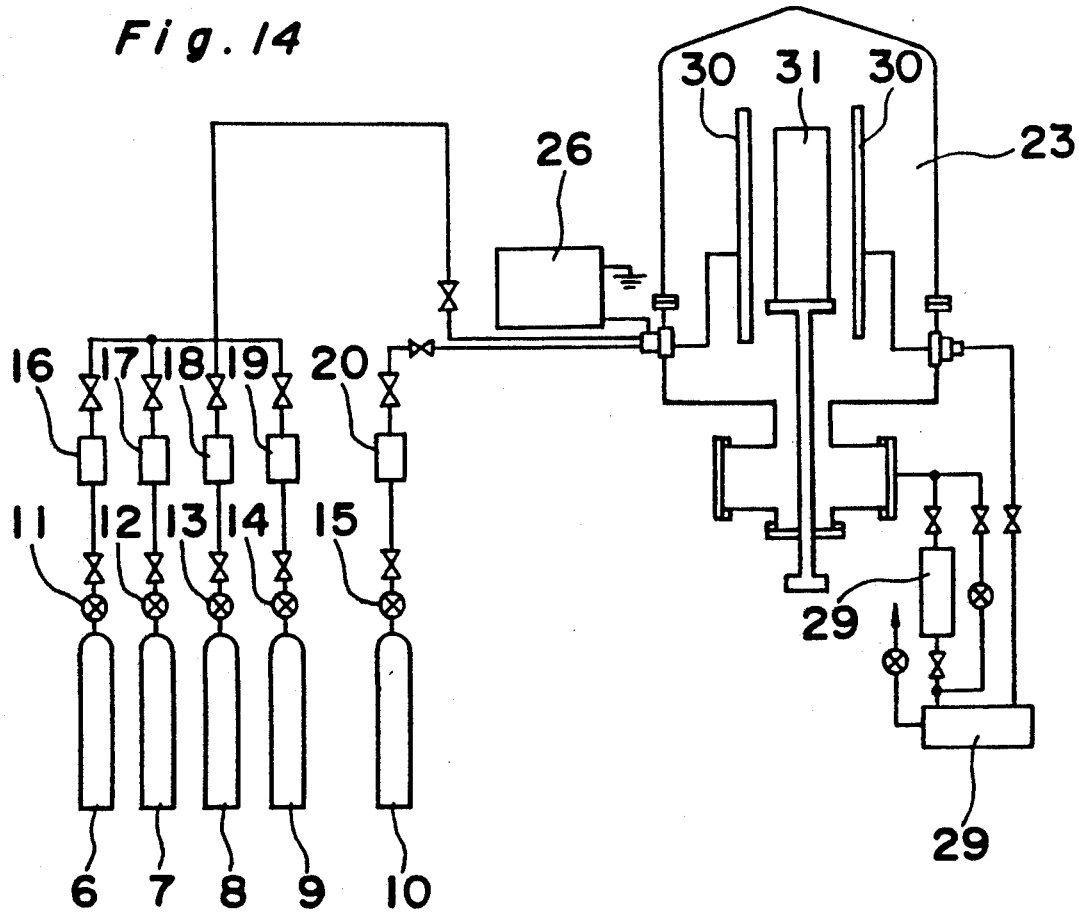

FIGS. 13 and 14 illustrate a capacitive coupling type plasma CVD apparatus for the production of the photosensitive member of the present invention. FIG. 13 shows a parallel plate type plasma CVD apparatus, and FIG. 14 shows a tubular plasma CVD apparatus. The apparatuses are different in that electrodes (22) and (25) and the substrate (24) of FIG. 13 are plates, but in FIG. 14 a electrode (30) and substrate (31) are tubular. In the present invention, of course, a photosensitive member can be produced by an induction coupling type plasma CVD apparatus.

Production of the photosensitive member of the present invention is illustrated according to the parallel plate type plasma CVD apparatus (FIG. 13). In FIG. 13, (6)–(10) show the 1st to 5th tanks for $C_2H_4$, $H_2$, $B_2H_6$, $SiH_4$ and $N_2O$ or $PH_3$ gases (instead of $N_2O$) respectively, each of which is connected to the 1st to 5th control valves (11)–(15) and the 1st to 5th mass flow controllers (16) to (20) respectively. These gases are sent to a reactor (23) through a main pipe (21).

In the reactor (23) a grounded electrode plate (25), on which the electroconductive substrate such as an Al plate (24) is arranged, is electrically connected with the plate-like electrode (22), which is connected with a high frequency current source (26), facing each other through the condenser. The electrode (22) is connected with a direct current source (28) through a coil (27) in such a manner that a bias is applied in addition to the electric power from the frequency current source (26). The electroconductive substrate (24), set on the electrode (25), is arranged such that it can be heated to, for example, 350° C. by a heating means (not illustrated).

When a photosensitive, member illustrated in FIG. 1, for example, is prepared with $C_2H_4$, and $H_2$ gas as a carrier gas the gases may be supplied from the first tank (6) and the second tank (7) respectively through the main pipe (21) after the reactor is established at a constant vacuum. Then an electric power of 0.03–1 kw is applied from the frequency current source (26) to the electrode (22) to cause plasma discharge between both electrodes to form a C:H charge transporting layer (2) of 5 to 50 μm thick on a preheated substrate (24). The hydrogen content of the C:H charge transporting layer is dependent on production conditions such as the kind of starting materials, the ratio of the materials and the diluting gas ($H_2$ gas or inert gas such as He), discharging power, pressure, substrate temperature, DC bias, anneal temperature, and the frequency at discharge. The hydrogen content can be controlled by varying the bias from 0.05 to 1 kv. That is, the hydrogen content can be reduced by applying a higher bias so as to increase the hardness of the C:H charge transporting layer. The C:H charge transporting layer obtained has excellent light transmittance, dark resistance and carrier transportability. The layer may be controlled to be a P type by the introduction of $B_2H_6$ gas from the third tank (8) and $N_2O$ gas from 5th tank (10) to improve the charge transportability still more. If $PH_3$ gas is used instead of $B_2H_6$, the layer can be controlled to be a N type.

As a charge generating layer (3) a layer mainly made of a-Si may be applied by introduction of $H_2$ gas and $SiH_4$ from the 2nd tank (7) and the 4th tank (9) respectively.

The egopt is dependent on the kind of starting gaseous materials, the ratio of the starting materials and the diluting gas ($H_2$ and inert gas etc. , charging power, pressure, substrate temperature, DC bias, anneal temperature, discharging frequency and the like. Discharging power, substrate temperature especially and anneal temperature affect the egopt.

The egopt of the present invention can be calculated from the absorption edge by the formula of $\sqrt{\alpha h\nu}-h\nu$ wherein $\alpha$ represents the absorption coefficient and $h\nu$ represents light energy.

The relative dielectric constant of the C:H charge transporting layer is dependent on the kind of starting gaseous material, DC bias generated by discharge or applied from outside, discharging power and the like, and can be controlled by changing them.

Figure 15:
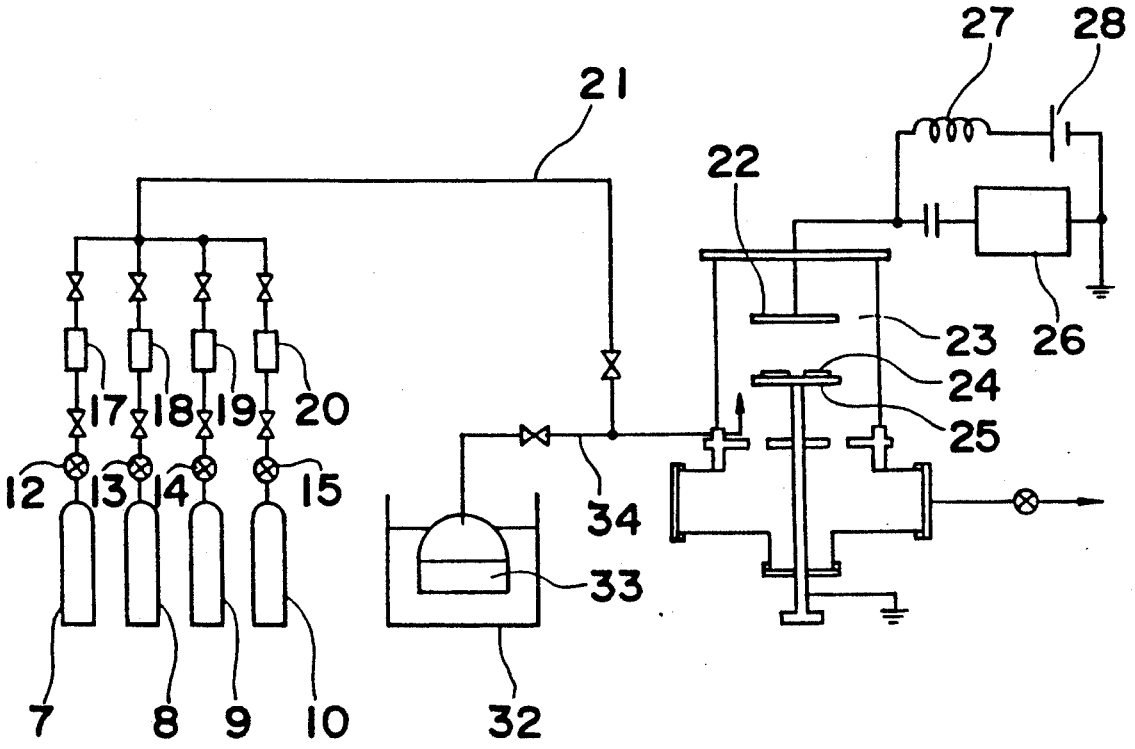

A capacitance coupling CVD apparatus as shown in FIG. 15 illustrates an embodiment using a monomer such as $C_8H_8$ as a source of the C:H charge transporting layer, in which a monomer (33) in a constant temperature bath (32), as well as pipe (34) connected to the reactor, is heated for introduction into the reactor (23) as a vapor. The other constitutions are the same as FIG. 13.

The photosensitive member of the present invention has excellent charge transportance and charging capacity, and a sufficient surface potential can be obtained even when the thickness of the C:H charge transporting layer is thin.

The production costs are low, and the production time is short, because the cost of the raw material is cheap, every layer can be formed in the same reactor, and the layers can be thin. Even a thin C:H charge transporting layer can be easily produced without pin holes. If the C:H charge transporting layer of the present invention is used as an outmost surface, durability of the photosensitive member is improved because of its excellent resistance to corona, acids, moisture, heat and rigidity.

The present invention is illustrated by the following examples, but it should not be construed restrictively to them.

EXAMPLE 1

(I) Formation of C:H charge transporting layer

In the glow discharge decomposition apparatus shown in FIG. 13, the reactor (23) is evacuated to a high vacuum of about $10^{-6}$ Torr, and then the 1st, 2nd and 3rd controlling valves (11), (12) and (13) were opened to send $C_2H_4$ gas from the 1st tank 6), $H_2$ gas from the 2nd tank (7) and $B_2H_6$ gas from the 3rd tank (8) to mass flow controllers (16)–(18) respectively under an output gauge of 1 Kg/cm$^2$. Thereafter, the flow rate of $C_2H_4$ and $H_2$ gases were respectively adjusted by the scales of the respective mass flow controllers shown in Table 1, and the gases were sent to the reactor (23). In the Table 1, $B_2H_6+H_2$ (sccm) represents the total of the scales of the mass flow controllers of $B_2H_6$ gas and Hgas, and then $B_2H_6/C_2H_4$ (ppm) is a ratio of density of $B_2H_6$ gas to $C_2H_4$ gas. After the flow rate of every gas was stabilized, the inner pressure of the reactor was adjusted to 0.5 Torr. Separately, an aluminum plate of 3×50×50 mm, the electroconductive substrate (24), was preheated to 250° C. When each the flow rate of the gases and the inner pressure were stabilized, a high-frequency power of 200 watts (frequency, 13.56 MHz) and a direct current voltage power (+400 volts) were applied to the electrode (22) from the power source (26) and (28) to continue plasma polymerization for 10 hours to form C:H charge transporting layer on the substrate (24). The flow rates of the gases, the condition for production and properties of the resultant layer are shown in the Table 1.

(II) Formation of a-Si charge generating layer

The application of power from the high frequency power source (26) was temporarily stopped, and the reactor was evacuated.

The 4th to 2nd controlling valves (14)–(12) were opened to sent $SiH_4$ gas from the 4th tank (9), $B_2H_6$ gas from the 3rd tank (8) and $H_2$ gas from the 2 nd tank (7) to mass flow controllers (19)–(17) respectively under the adjusted flow rates shown in Table 1. Each gases were sent to the reactor. After the flow rates were stabilized, the inner pressure of the reactor (23) was adjusted to 1.0 Torr.

When the flow rate and the inner pressure were stabilized, a high frequency power (frequency, 13.56 MHz) of 10 watts and a direct current voltage power were applied to the substrate with the C:H charge transporting layer from the electrode (22) to generate the glow discharge. The condition for production and properties of the obtained photosensitive member are shown in Table 1, in which $V_0$ is a initial surface potential, $E_{\frac{1}{2}}$ is an exposure amount for half reduction of the surface potential and $V_r$ is a residual potential.

The properties of the above photosensitive member, i.e. an initial surface potential, and exposure amount for half reduction of surface potential and residual potential are evaluated in the following table as excellent (o), good (Δ), unacceptable (x), so that the excellence of the invention can be understood.

| properties | evaluation o | Δ | x |
|---|---|---|---|
| $V_0$ (V)/member thickness (μm) | 70–40 | 40–10 | 10–0 |
| $E_{\frac{1}{2}}$ (lux · sec) | 1.9–3.6 | 3.7–6.9 | 7.0– |
| $V_r/V_0$ (%) | 0–25 | 25–50 | 50–100 |

TABLE 1

| | (Example 1) CTL[1)] | CGL[2)] |
|---|---|---|
| $C_2H_4$ (sccm) | 10 | — |
| $B_2H_6 + H_2$ (sccm) | 100 | 210 |
| $B_2H_6/C_2H_4$ (sccm) | 2 | |
| $SiH_4$ (sccm) | — | 90 |
| $PH_3/C_2H_4$ (ppm) | — | — |
| $B_2H_6/SiH_4$ (ppm) | — | 20 |
| Power (W) | 200 | 10 |
| inner pressure of reactor (Torr) | 0.5 | 1.0 |
| direct current (v) | +400 | — |
| time | 10 (hour) | 40 (minute) |
| thickness of layer (μm) | 7 | 0.5 |
| hydrogen content $= \frac{H}{\text{all atoms}}$ (atomic %) | 40 | — |
| $V_0$ (V) | +400 | |
| $E_{\frac{1}{2}}$ (lux · sec) | 5.5 | |
| additional matter content (ppm) | $2\left(\frac{B}{C+B}\right)$ | $20\left(\frac{B}{Si+B}\right)$ |
| residual potential Vr (V) | 150 | |
| adhesivity to substrate | Δ | |

[1)]charge transporting layer (abbreviated to CTL hereinafter)
[2)]charge generating layer (abbreviated to CGL hereinafter)

EXAMPLE 2–28

Photosensitive members having a carrier transporting layer polarity of which were controlled were prepared in a condition for production shown in Table 2–28 according to the same manner as example 1. Properties of an obtained photosensitive layer are shown in Table 2–28.

In a meanwhile, $PH_3$ gas was provided from the 5th tank (10) and introduced through the mass flow controller (20) to the reactor.

TABLE 2

| | (Example 2) CTL | CGL |
|---|---|---|
| $CH_4$ (sccm) | 30 | — |
| $B_2H_6 + H_2$ (sccm) | 90 | 210 |
| $B_2H_6/C_2H_4$ (sccm) | 200 | — |
| $SiH_4$ (sccm) | — | 90 |
| $PH_3/C_2H_4$ (ppm) | — | — |
| $B_2H_6/SiH_4$ (ppm) | — | 1 |
| Power (W) | 30 | 20 |
| inner pressure of reactor (Torr) | $5 \times 10^{-2}$ | 1.0 |
| direct current (v) | +600 | — |
| time | 10 (hour) | 20 (minute) |
| thickness of layer (μm) | 5 | 1 |

TABLE 2-continued

| | (Example 2) CTL | CGL |
|---|---|---|
| hydrogen content $= \frac{H}{\text{all atoms}}$ (atomic %) | 10 | — |
| $V_0$ (V) | +230 | |
| $E_{\frac{1}{2}}$ (lux · sec) | 2.5 | |
| additional matter content (ppm) | $400\left(\frac{B}{C+B}\right)$ | $1\left(\frac{B}{Si+B}\right)$ |
| residual potential Vr (V) | 50 | |
| adhesivity to substrate | ○ | |

TABLE 3

| | (Example 3) CTL | CGL |
|---|---|---|
| $C_2H_4$ (sccm) | 10 | — |
| $B_2H_6 + H_2$ (sccm) | 100 | 210 |
| $B_2H_6/C_2H_4$ (sccm) | 5 | — |
| $SiH_4$ (sccm) | — | 90 |
| $PH_3/C_2H_4$ (ppm) | — | — |
| $B_2H_6/SiH_4$ (ppm) | — | 20 |
| Power (W) | 200 | 10 |
| inner pressure of reactor (Torr) | 0.5 | 1.0 |
| direct current (v) | +400 | — |
| time | 10 (hour) | 40 (minute) |
| thickness of layer (μm) | 7 | 0.5 |
| hydrogen content $= \frac{H}{\text{all atoms}}$ (atomic %) | 40 | — |
| $V_0$ (V) | +400 | |
| $E_{\frac{1}{2}}$ (lux · sec) | 3.5 | |
| additional matter content (ppm) | $5\left(\frac{B}{C+B}\right)$ | $20\left(\frac{B}{Si+B}\right)$ |
| residual potential Vr (V) | 100 | |
| adhesivity to substrate | ○ | |

TABLE 4

| | (Example 4) CTL | CGL |
|---|---|---|
| $C_2H_4$ (sccm) | 10 | — |
| $B_2H_6 + H_2$ (sccm) | 100 | 210 |
| $B_2H_6/C_2H_4$ (sccm) | 20 | — |
| $SiH_4$ (sccm) | — | 90 |
| $PH_3/C_2H_4$ (ppm) | — | — |
| $B_2H_6/SiH_4$ (ppm) | — | 20 |
| Power (W) | 200 | 10 |
| inner pressure of reactor (Torr) | 0.5 | 1.0 |
| direct current (v) | +400 | — |
| time | 10 (hour) | 40 (minute) |
| thickness of layer (μm) | 7 | 0.5 |
| hydrogen content $= \frac{H}{\text{all atoms}}$ (atomic %) | 40 | — |
| $V_0$ (V) | +400 | |

TABLE 4-continued

| | (Example 4) CTL | CGL |
|---|---|---|
| $E_{\frac{1}{2}}$ (lux · sec) | 3.1 | |
| additional matter content (ppm) | $20\left(\frac{B}{C+B}\right)$ | $20\left(\frac{B}{Si+B}\right)$ |
| residual potential Vr (V) | 80 | |
| adhesivity to substrate | ○ | |

TABLE 5

| | (Example 5) CTL | CGL |
|---|---|---|
| $C_2H_4$ (sccm) | 10 | — |
| $B_2H_6 + H_2$ (sccm) | 100 | 210 |
| $B_2H_6/C_2H_4$ (sccm) | 50 | — |
| $SiH_4$ (sccm) | — | 90 |
| $PH_3/C_2H_4$ (ppm) | — | — |
| $B_2H_6/SiH_4$ (ppm) | — | 20 |
| Power (W) | 200 | 10 |
| inner pressure of reactor (Torr) | 0.5 | 1.0 |
| direct current (v) | +400 | — |
| time | 10 (hour) | 40 (minute) |
| thickness of layer (μm) | 7 | 0.5 |
| hydrogen content $= \frac{H}{\text{all atoms}}$ (atomic %) | 40 | — |
| $V_0$ (V) | +400 | |
| $E_{\frac{1}{2}}$ (lux · sec) | 2.8 | |
| additional matter content (ppm) | $50\left(\frac{B}{C+B}\right)$ | $20\left(\frac{B}{Si+B}\right)$ |
| residual potential Vr (V) | 60 | |
| adhesivity to substrate | ○ | |

TABLE 6

| | (Example 6) CTL | CGL |
|---|---|---|
| $C_2H_4$ (sccm) | 10 | — |
| $B_2H_6 + H_2$ (sccm) | 100 | 210 |
| $B_2H_6/C_2H_4$ (sccm) | 200 | — |
| $SiH_4$ (sccm) | — | 90 |
| $PH_3/C_2H_4$ (ppm) | — | — |
| $B_2H_6/SiH_4$ (ppm) | — | 20 |
| Power (W) | 200 | 10 |
| inner pressure of reactor (Torr) | 0.5 | 1.0 |
| direct current (v) | +400 | — |
| time | 10 (hour) | 40 (minute) |
| thickness of layer (μm) | 7 | 0.5 |
| hydrogen content $= \frac{H}{\text{all atoms}}$ (atomic %) | 40 | — |
| $V_0$ (V) | +400 | |
| $E_{\frac{1}{2}}$ (lux · sec) | 2.1 | |

TABLE 6-continued

| | (Example 6) CTL | CGL |
|---|---|---|
| additional matter content (ppm) | $200\left(\frac{B}{C+B}\right)$ | $20\left(\frac{B}{Si+B}\right)$ |
| residual potential Vr (V) | 40 | |
| adhesivity to substrate | ○ | |

TABLE 7

| | (Example 7) CTL | CGL |
|---|---|---|
| $C_2H_4$ (sccm) | 10 | — |
| $B_2H_6 + H_2$ (sccm) | 100 | 210 |
| $B_2H_6/C_2H_4$ (sccm) | 1000 | — |
| $SiH_4$ (sccm) | — | 90 |
| $PH_3/C_2H_4$ (ppm) | — | — |
| $B_2H_6/SiH_4$ (ppm) | — | 20 |
| Power (W) | 200 | 10 |
| inner pressure of reactor (Torr) | 0.5 | 1.0 |
| direct current (v) | +400 | — |
| time | 10 (hour) | 40 (minute) |
| thickness of layer (μm) | 7 | 0.5 |
| hydrogen content $= \frac{H}{\text{all atoms}}$ (atomic %) | 40 | — |
| $V_0$ (V) | +400 | |
| $E_{\frac{1}{2}}$ (lux · sec) | 2.5 | |
| additional matter content (ppm) | $1000\left(\frac{B}{C+B}\right)$ | $20\left(\frac{B}{Si+B}\right)$ |
| residual potential Vr (V) | 50 | |
| adhesivity to substrate | ○ | |

TABLE 8

| | (Example 8) CTL | CGL |
|---|---|---|
| $C_2H_4$ (sccm) | 10 | — |
| $B_2H_6 + H_2$ (sccm) | 100 | 210 |
| $B_2H_6/C_2H_4$ (sccm) | 5000 | — |
| $SiH_4$ (sccm) | — | 90 |
| $PH_3/C_2H_4$ (ppm) | — | — |
| $B_2H_6/SiH_4$ (ppm) | — | 20 |
| Power (W) | 200 | 10 |
| inner pressure of reactor (Torr) | 0.5 | 1.0 |
| direct current (v) | +400 | — |
| time | 10 (hour) | 40 (minute) |
| thickness of layer (μm) | 7 | 0.5 |
| hydrogen content $= \frac{H}{\text{all atoms}}$ (atomic %) | 40 | — |
| $V_0$ (V) | +260 | |
| $E_{\frac{1}{2}}$ (lux · sec) | 3.9 | |
| additional matter content (ppm) | $5000\left(\frac{B}{C+B}\right)$ | $20\left(\frac{B}{Si+B}\right)$ |

TABLE 8-continued

| | (Example 8) CTL | CGL |
|---|---|---|
| residual potential Vr (V) | 80 | |
| adhesivity to substrate | ○ | |

TBALE 9

| | (Example 9) CTL | CGL |
|---|---|---|
| $C_2H_4$ (sccm) | 10 | — |
| $B_2H_6 + H_2$ (sccm) | 100 | 210 |
| $B_2H_6/C_2H_4$ (scm) | 20000 | — |
| $SiH_4$ (sccm) | — | 90 |
| $PH_3/C_2H_4$ (ppm) | — | — |
| $B_2H_6/SiH_4$ (ppm) | — | 20 |
| Power (W) | 200 | 10 |
| inner pressure of reactor (Torr) | 0.5 | 1.0 |
| direct current (v) | +400 | — |
| time | 10 (hour) | 40 (minute) |
| thickness of layer (μm) | 7 | 0.5 |
| hydrogen content $= \frac{H}{\text{all atoms}}$ (atomic %) | 40 | — |
| $V_0$ (V) | +120 | |
| $E_{\frac{1}{2}}$ (lux · sec) | 5.0 | |
| additional matter content (ppm) | $20000\left(\frac{B}{C+B}\right)$ | $20\left(\frac{B}{Si+B}\right)$ |
| residual potential Vr (V) | 40 | |
| adhesivity to substrate | ○ | |

TABLE 10

| | (Example 10) CTL | CGL |
|---|---|---|
| $C_2H_4$ (sccm) | 10 | — |
| $H_2$ (sccm) | — | 210 |
| $B_2H_6/C_2H_4$ (sccm) | — | — |
| $SiH_4$ (sccm) | — | 90 |
| $PH_3/C_2H_4$ (ppm) | 1 | — |
| $B_2H_6/SiH_4$ (ppm) | — | 0 |
| Power (W) | 200 | 10 |
| inner pressure of reactor (Torr) | 0.5 | 1.0 |
| direct current (v) | +400 | — |
| time | 10 (hour) | 40 (minute) |
| thickness of layer (μm) | 7 | 0.5 |
| hydrogen content $= \frac{H}{\text{all atoms}}$ (atomic %) | 40 | — |
| $V_0$ (V) | −400 | |
| $E_{\frac{1}{2}}$ (lux · sec) | 3.6 | |
| additional matter content (ppm) | $1\left(\frac{P}{C+P}\right)$ | $0\left(\frac{P}{Si+P}\right)$ |
| residual potential Vr (V) | −100 | |
| adhesivity to substrate | ○ | |

TABLE 10-continued

| | (Example 10) CTL | CGL |
|---|---|---|
| substrate | | |

TABLE 11

| | (Example 11) CTL | CGL |
|---|---|---|
| $C_2H_4$ (sccm) | 10 | — |
| $H_2$ (sccm) | 100 | 210 |
| $B_2H_6/C_2H_4$ (sccm) | — | — |
| $SiH_4$ (sccm) | — | 90 |
| $PH_3/C_2H_4$ (ppm) | 5 | — |
| $B_2H_6/SiH_4$ (ppm) | — | 0 |
| Power (W) | 200 | 10 |
| inner pressure of reactor (Torr) | 0.5 | 1.0 |
| direct current (v) | +400 | — |
| time | 10 (hour) | 40 (minute) |
| thickness of layer (μm) | 7 | 0.5 |
| hydrogen content $= \frac{H}{\text{all atoms}}$ (atomic %) | 40 | — |
| $V_0$ (V) | −400 | |
| $E_{\frac{1}{2}}$ (lux · sec) | 3.2 | |
| additional matter content (ppm) | $5\left(\frac{P}{C+P}\right)$ | $0\left(\frac{P}{Si+P}\right)$ |
| residual potential Vr (V) | −80 | |
| adhesivity to substrate | ○ | |

TABLE 12

| | (Example 12) CTL | CGL |
|---|---|---|
| $C_2H_4$ (sccm) | 10 | — |
| $H_2$ (sccm) | 100 | 210 |
| $B_2H_6/C_2H_4$ (sccm) | — | — |
| $SiH_4$ (sccm) | — | 90 |
| $PH_3/C_2H_4$ (ppm) | 20 | — |
| $B_2H_6/SiH_4$ (ppm) | — | 0 |
| Power (W) | 200 | 10 |
| inner pressure of reactor (Torr) | 0.5 | 1.0 |
| direct current (v) | +400 | — |
| time | 10 (hour) | 40 (minute) |
| thickness of layer (μm) | 7 | 0.5 |
| hydrogen content $= \frac{H}{\text{all atoms}}$ (atomic %) | 40 | — |
| $V_0$ (V) | −400 | |
| $E_{\frac{1}{2}}$ (lux · sec) | 2.8 | |
| additional matter content (ppm) | $20\left(\frac{P}{C+P}\right)$ | $0\left(\frac{P}{Si+P}\right)$ |
| residual potential Vr (V) | −60 | |
| adhesivity to substrate | ○ | |

TABLE 13

| | (Example 13) CTL | CGL |
|---|---|---|
| $C_2H_4$ (sccm) | 10 | — |
| $H_2$ (sccm) | 100 | 210 |
| $B_2H_6/C_2H_4$ (sccm) | — | — |
| $SiH_4$ (sccm) | — | 90 |
| $PH_3/C_2H_4$ (ppm) | 50 | — |
| $B_2H_6/SiH_4$ (ppm) | — | 0 |
| Power (W) | 200 | 10 |
| inner pressure of reactor (Torr) | 0.5 | 1.0 |
| direct current (v) | +400 | — |
| time | 10 (hour) | 40 (minute) |
| thickness of layer (μm) | 7 | 0.5 |
| hydrogen content $= \frac{H}{\text{all atoms}}$ (atomic %) | 40 | — |
| $V_0$ (V) | −400 | |
| $E_{\frac{1}{2}}$ (lux · sec) | 2.5 | |
| additional matter content (ppm) | $50\left(\frac{P}{C+P}\right)$ | $0\left(\frac{P}{Si+P}\right)$ |
| residual potential Vr (V) | −50 | |
| adhesivity to substrate | ○ | |

TABLE 14

| | (Example 14) CTL | CGL |
|---|---|---|
| $C_2H_4$ (sccm) | 10 | — |
| $H_2$ (sccm) | 100 | 210 |
| $B_2H_6/C_2H_4$ (sccm) | — | — |
| $SiH_4$ (sccm) | — | 90 |
| $PH_3/C_2H_4$ (ppm) | 200 | — |
| $B_2H_6/SiH_4$ (ppm) | — | 0 |
| Power (W) | 200 | 10 |
| inner pressure of reactor (Torr) | 0.5 | 1.0 |
| direct current (v) | +400 | — |
| time | 10 (hour) | 40 (minute) |
| thickness of layer (μm) | 7 | 0.5 |
| hydrogen content $= \frac{H}{\text{all atoms}}$ (atomic %) | 40 | — |
| $V_0$ (V) | −400 | |
| $E_{\frac{1}{2}}$ (lux · sec) | 2.1 | |
| additional matter content (ppm) | $200\left(\frac{P}{C+P}\right)$ | $0\left(\frac{P}{Si+P}\right)$ |
| residual potential Vr (V) | −40 | |
| adhesivity to substrate | ○ | |

TABLE 15

| | (Example 15) CTL | CGL |
|---|---|---|
| $C_2H_4$ (sccm) | 10 | — |
| $H_2$ (sccm) | 100 | 210 |
| $B_2H_6/C_2H_4$ (sccm) | — | — |
| $SiH_4$ (sccm) | — | 90 |
| $PH_3/C_2H_4$ (ppm) | 1000 | — |

TABLE 15-continued

| | (Example 15) CTL | CGL |
|---|---|---|
| $B_2H_6/SiH_4$ (ppm) | — | 0 |
| Power (W) | 200 | 10 |
| inner pressure of reactor (Torr) | 0.5 | 1.0 |
| direct current (v) | +400 | — |
| time | 10 (hour) | 40 (minute) |
| thickness of layer (μm) | 7 | 0.5 |
| hydrogen content $= \frac{H}{\text{all atoms}}$ (atomic %) | 40 | — |
| $V_0$ (V) | −400 | |
| $E_{\frac{1}{2}}$ (lux · sec) | 3.0 | |
| additional matter content (ppm) | $1000\left(\frac{P}{C+P}\right)$ | $0\left(\frac{P}{Si+P}\right)$ |
| residual potential Vr (V) | −90 | |
| adhesivity to substrate | ○ | |

TABLE 16

| | (Example 16) CTL | CGL |
|---|---|---|
| $C_2H_4$ (sccm) | 10 | — |
| $H_2$ (sccm) | 100 | 210 |
| $B_2H_6/C_2H_4$ (sccm) | — | — |
| $SiH_4$ (sccm) | — | 90 |
| $PH_3/C_2H_4$ (ppm) | 5000 | — |
| $B_2H_6/SiH_4$ (ppm) | — | 0 |
| Power (W) | 200 | 10 |
| inner pressure of reactor (Torr) | 0.5 | 1.0 |
| direct current (v) | +400 | — |
| time | 10 (hour) | 40 (minute) |
| thickness of layer (μm) | 7 | 0.5 |
| hydrogen content $= \frac{H}{\text{all atoms}}$ (atomic %) | 40 | — |
| $V_0$ (V) | −160 | |
| $E_{\frac{1}{2}}$ (lux · sec) | 4.5 | |
| additional matter content (ppm) | $5000\left(\frac{P}{C+P}\right)$ | $0\left(\frac{P}{Si+P}\right)$ |
| residual potential Vr (V) | −50 | |
| adhesivity to substrate | ○ | |

TABLE 17

| | (Example 17) CTL | CGL |
|---|---|---|
| $C_2H_4$ (sccm) | 10 | — |
| $H_2$ (sccm) | 100 | 210 |
| $B_2H_6/C_2H_4$ (sccm) | — | — |
| $SiH_4$ (sccm) | — | 90 |
| $PH_3/C_2H_4$ (ppm) | 20000 | — |
| $B_2H_6/SiH_4$ (ppm) | — | 0 |
| Power (W) | 200 | 10 |
| inner pressure of reactor (Torr) | 0.5 | 1.0 |
| direct current (v) | +400 | — |

TABLE 17-continued

| (Example 17) | CTL | CGL |
|---|---|---|
| time | 10 (hour) | 40 (minute) |
| thickness of layer (μm) | 7 | 0.5 |
| hydrogen content $= \frac{H}{\text{all atoms}}$ (atomic %) | 40 | — |
| $V_0$ (V) | −80 | |
| $E_{\frac{1}{2}}$ (lux · sec) | 6.9 | |
| additional matter content (ppm) | $20000\left(\frac{P}{C+P}\right)$ | $0\left(\frac{P}{Si+P}\right)$ |
| residual potential Vr (V) | −30 | |
| adhesivity to substrate | ○ | |

TABLE 18

| (Example 18) | CTL | CGL |
|---|---|---|
| $C_2H_4$ (sccm) | 30 | — |
| $H_2$ (sccm) | 40 | 210 |
| $B_2H_6/C_2H_4$ (sccm) | — | — |
| $SiH_4$ (sccm) | — | 90 |
| $PH_3/C_2H_4$ (ppm) | 400 | — |
| $B_2H_6/SiH_4$ (ppm) | — | 0 |
| Power (W) | 100 | 10 |
| inner pressure of reactor (Torr) | 0.5 | 1.0 |
| direct current (v) | 0 | — |
| time | 4 (hour) | 40 (minute) |
| thickness of layer (μm) | 5 | 0.5 |
| hydrogen content $= \frac{H}{\text{all atoms}}$ (atomic %) | 50 | — |
| $V_0$ (V) | −300 | |
| $E_{\frac{1}{2}}$ (lux · sec) | 7.0 | |
| additional matter content (ppm) | $200\left(\frac{P}{P+C}\right)$ | |
| residual potential Vr (V) | −140 | |
| adhesivity to substrate | ○ | |

TABLE 19

| (Example 19) | CTL | CGL |
|---|---|---|
| $C_2H_4$ (sccm) | 30 | — |
| $H_2$ (sccm) | 40 | 210 |
| $B_2H_6/C_2H_4$ (sccm) | 200 | — |
| $SiH_4$ (sccm) | — | 90 |
| $PH_3/C_2H_4$ (ppm) | — | — |
| $B_2H_6/SiH_4$ (ppm) | — | 20 |
| Power (W) | 100 | 10 |
| inner pressure of reactor (Torr) | 0.5 | 1.0 |
| direct current (v) | 0 | — |
| time | 4 (hour) | 40 (minute) |
| thickness of layer (μm) | 5 | 1 |

TABLE 19-continued

| (Example 19) | CTL | CGL |
|---|---|---|
| hydrogen content $= \frac{H}{\text{all atoms}}$ (atomic %) | 50 | — |
| $V_0$ (V) | 250 | |
| $E_{\frac{1}{2}}$ (lux · sec) | 3.6 | |
| additional matter content (ppm) | $200\left(\frac{B}{B+C}\right)$ | $200\left(\frac{B}{Si+B}\right)$ |
| residual potential Vr (V) | ○ | |
| adhesivity to substrate | ○ | |

TABLE 20

| (Example 20) | CTL | CGL |
|---|---|---|
| $C_2H_4$ (sccm) | 30 | — |
| $H_2$ (sccm) | 40 | 210 |
| $B_2H_6/C_2H_4$ (sccm) | — | — |
| $SiH_4$ (sccm) | — | 90 |
| $PH_3/C_2H_4$ (ppm) | 400 | — |
| $B_2H_6/SiH_4$ (ppm) | — | 0 |
| Power (W) | 100 | 10 |
| inner pressure of reactor (Torr) | 0.5 | 1.0 |
| direct current (v) | +60 | — |
| time | 8 (hour) | 40 (minute) |
| thickness of layer (μm) | 5.7 | 0.5 |
| hydrogen content $= \frac{H}{\text{all atoms}}$ (atomic %) | 56 | — |
| $V_0$ (V) | −330 | |
| $E_{\frac{1}{2}}$ (lux · sec) | 1.9 | |
| additional matter content (ppm) | $200\left(\frac{P}{P+C}\right)$ | |
| residual potential Vr (V) | ○ | |
| adhesivity to substrate | ○ | |

TABLE 21

| (Example 21) | CTL | CGL |
|---|---|---|
| $C_2H_4$ (sccm) | 90 | — |
| $H_2$ (sccm) | 120 | 210 |
| $B_2H_6/C_2H_4$ (sccm) | — | — |
| $SiH_4$ (sccm) | — | 90 |
| $PH_3/C_2H_4$ (ppm) | 400 | — |
| $B_2H_6/SiH_4$ (ppm) | — | 0 |
| Power (W) | 300 | 10 |
| inner pressure of reactor (Torr) | 0.5 | 1.0 |
| direct current (v) | +120 | — |
| time | 8 (hour) | 40 (minute) |
| thickness of layer (μm) | 12 | 0.5 |
| hydrogen content $= \frac{H}{\text{all atoms}}$ (atomic %) | 49 | — |

TABLE 21-continued

| (Example 21) | CTL | CGL |
|---|---|---|
| $V_0$ (V) | −490 | |
| $E_{\frac{1}{2}}$ (lux · sec) | 3.4 | |
| additional matter content (ppm) | $400\left(\frac{P}{P+C}\right)$ | |
| residual potential Vr (V) | ∘ | |
| adhesivity to substrate | ∘ | |

TABLE 22

| (Example 22) | CTL | CGL |
|---|---|---|
| $C_2H_4$ (sccm) | 180 | — |
| $H_2$ (sccm) | 240 | 210 |
| $B_2H_6/C_2H_4$ (sccm) | — | — |
| $SiH_4$ (sccm) | — | 90 |
| $PH_3/C_2H_4$ (ppm) | 400 | — |
| $B_2H_6/SiH_4$ (ppm) | — | 0 |
| Power (W) | 600 | 10 |
| inner pressure of reactor (Torr) | 0.5 | 1.0 |
| direct current (v) | +140 | — |
| time | 8 (hour) | 40 (minute) |
| thickness of layer (μm) | 16 | 0.5 |
| hydrogen content $= \frac{H}{\text{all atoms}}$ (atomic %) | 37 | — |
| $V_0$ (V) | −450 | |
| $E_{\frac{1}{2}}$ (lux · sec) | 3.6 | |
| additional matter content (ppm) | $400\left(\frac{P}{P+C}\right)$ | |
| residual potential Vr (V) | ∘ | |
| adhesivity to substrate | ∘ | |

TABLE 23

| (Example 23) | CTL | CGL |
|---|---|---|
| $C_2H_4$ (sccm) | 240 | — |
| $H_2$ (sccm) | 320 | 210 |
| $B_2H_6/C_2H_4$ (sccm) | | — |
| $SiH_4$ (sccm) | — | 90 |
| $PH_3/C_2H_4$ (ppm) | 400 | — |
| $B_2H_6/SiH_4$ (ppm) | — | 0 |
| Power (W) | 800 | 10 |
| inner pressure of reactor (Torr) | 0.5 | 1.0 |
| direct current (v) | +160 | — |
| time | 8 (hour) | 40 (minute) |
| thickness of layer (μm) | 17 | 0.5 |
| hydrogen content $= \frac{H}{\text{all atoms}}$ (atomic %) | 30 | — |
| $V_0$ (V) | −390 | |
| $E_{\frac{1}{2}}$ (lux · sec) | 3.6 | |

TABLE 23-continued

| (Example 23) | CTL | CGL |
|---|---|---|
| additional matter content (ppm) | $400\left(\frac{P}{P+C}\right)$ | |
| residual potential Vr (V) | ∘ | |
| adhesivity to substrate | ∘ | |

TABLE 24

| (Example 24) | CTL | CGL |
|---|---|---|
| $CH_4$ (sccm) | 100 | — |
| $H_2$ (sccm) | 100 | 210 |
| $B_2H_6/CH_4$ (sccm) | | — |
| $SiH_4$ (sccm) | — | 90 |
| $PH_3/CH_4$ (ppm) | 200 | — |
| $B_2H_6/SiH_4$ (ppm) | — | 0 |
| Power (W) | 600 | 10 |
| inner pressure of reactor (Torr) | 0.2 | 1.0 |
| direct current (v) | +300 | — |
| time | 16 (hour) | 40 (minute) |
| thickness of layer (μm) | 5.2 | 0.5 |
| hydrogen content $= \frac{H}{\text{all atoms}}$ (atomic %) | 41 | — |
| $V_0$ (V) | −150 | |
| $E_{\frac{1}{2}}$ (lux · sec) | 3.6 | |
| additional matter content (ppm) | $200\left(\frac{P}{P+C}\right)$ | |
| residual potential Vr (V) | ∘ | |
| adhesivity to substrate | ∘ | |

TABLE 25

| (Example 25) | CTL | CGL |
|---|---|---|
| $C_3H_6$ (sccm) | 80 | — |
| $H_2$ (sccm) | 20 | 210 |
| $B_2H_6/C_3H_6$ (sccm) | | — |
| $SiH_4$ (sccm) | — | 90 |
| $PH_3/C_3H_6$ (ppm) | 600 | — |
| $B_2H_6/SiH_4$ (ppm) | — | 0 |
| Power (W) | 200 | 10 |
| inner pressure of reactor (Torr) | 1.0 | 1.0 |
| direct current (v) | 0 | — |
| time | 6 (hour) | 40 (minute) |
| thickness of layer (μm) | 7.3 | 0.5 |
| hydrogen content $= \frac{H}{\text{all atoms}}$ (atomic %) | 60 | — |
| $V_0$ (V) | −420 | |
| $E_{\frac{1}{2}}$ (lux · sec) | 3.6 | |
| additional matter content (ppm) | $600\left(\frac{P}{P+C}\right)$ | |

TABLE 25-continued

| (Example 25) | CTL | CGL |
|---|---|---|
| residual potential Vr (V) | ○ | |
| adhesivity to substrate | ○ | |

TABLE 26

| (Example 26) | CTL | CGL |
|---|---|---|
| $i\text{-}C_4H_{10}$ (sccm) | 180 | — |
| $H_2$ (sccm) | 120 | 210 |
| $B_2H_6/i\text{-}C_4H_{10}$ (sccm) | | — |
| $SiH_4$ (sccm) | — | 90 |
| $PH_3/i\text{-}C_4H_{10}$ (ppm) | 800 | — |
| $B_2H_6/SiH_4$ (ppm) | — | 0 |
| Power (W) | 500 | 10 |
| inner pressure of reactor (Torr) | 0.5 | 1.0 |
| direct current (v) | +200 | — |
| time | 8 (hour) | 40 (minute) |
| thickness of layer (μm) | 10 | 0.5 |
| hydrogen content $= \frac{H}{\text{all atoms}}$ (atomic %) | 45 | — |
| $V_0$ (V) | −330 | |
| $E_{\frac{1}{2}}$ (lux · sec) | 3.6 | |
| additional matter content (ppm) | $200\left(\frac{P}{P+C}\right)$ | |
| residual potential Vr (V) | ○ | |
| adhesivity to substrate | ○ | |

TABLE 27

| (Example 27) | CTL | CGL |
|---|---|---|
| $C_8H_8$ (sccm) | 50 | — |
| $H_2$ (sccm) | — | 210 |
| $B_2H_6/C_8H_8$ (sccm) | | — |
| $SiH_4$ (sccm) | — | 90 |
| $PH_3/C_8H_8$ (ppm) | 1600 | — |
| $B_2H_6/SiH_4$ (ppm) | — | 0 |
| Power (W) | 75 | 10 |
| inner pressure of reactor (Torr) | 0.25 | 1.0 |
| direct current (v) | 0 | — |
| time | 2 (hour) | 40 (minute) |
| thickness of layer (μm) | 6.8 | 0.5 |
| hydrogen content $= \frac{H}{\text{all atoms}}$ (atomic %) | 46 | — |
| $V_0$ (V) | −380 | |
| $E_{\frac{1}{2}}$ (lux · sec) | 2.1 | |
| additional matter content (ppm) | $200\left(\frac{P}{P+C}\right)$ | |
| residual potential Vr (V) | ○ | |
| adhesivity to substrate | ○ | |

TABLE 27-continued

| (Example 27) | CTL | CGL |
|---|---|---|
| substrate | | |

TABLE 28

| (Example 28) | CTL | CGL |
|---|---|---|
| $CH_4$ (sccm) | 30 | — |
| $H_2$ (sccm) | 30 | 210 |
| $B_2H_6/CH_4$ (sccm) | | — |
| $SiH_4$ (sccm) | — | 90 |
| $PH_3/CH_4$ (ppm) | 200 | — |
| $B_2H_6/SiH_4$ (ppm) | — | 0 |
| Power (W) | 5 | 10 |
| inner pressure of reactor (Torr) | $2 \times 10^{-3}$ | 1.0 |
| direct current (v) | +600 | — |
| time | 8 (hour) | 40 (minute) |
| thickness of layer (μm) | 5 | 1 |
| hydrogen content $= \frac{H}{\text{all atoms}}$ (atomic %) | 10 | — |
| $V_0$ (V) | −250 | |
| $E_{\frac{1}{2}}$ (lux · sec) | 2.1 | |
| additional matter content (ppm) | $200\left(\frac{P}{P+C}\right)$ | |
| residual potential Vr (V) | ○ | |
| adhesivity to substrate | ○ | |

COMPARATIVE EXAMPLE 1-5

Photosensitive member having a carrier transporting layer polarity of which were not controlled were prepared in a condition for production shown in Table 29-33 according to the same manner as Example 1.

In a meanwhile, $PH_3$ gas was provided from the 5th tank (10) and introduced through the mass flow controller (20) to the reactor.

TABLE 29

| (Comparative Example 1) | CTL | CGL |
|---|---|---|
| $CH_4$ (sccm) | 30 | — |
| $H_2$ (sccm) | 90 | 210 |
| $B_2H_6/CH_4$ (sccm) | 0 | — |
| $SiH_4$ (sccm) | — | 90 |
| $PH_3/CH_4$ (ppm) | — | — |
| $B_2H_6/SiH_4$ (ppm) | — | 20 |
| Power (W) | 30 | 20 |
| inner pressure of reactor (Torr) | $5 \times 10^{-2}$ | 1.0 |
| direct current (v) | +600 | — |
| time | 10 (hour) | 20 (minute) |
| thickness of layer (μm) | 5 | 1 |
| hydrogen content $= \frac{H}{\text{all atoms}}$ (atomic %) | 10 | — |
| $V_0$ (V) | +220 | |
| $E_{\frac{1}{2}}$ (lux · sec) | 25 | |

TABLE 29-continued

| (Comparative Example 1) | CTL | CGL |
|---|---|---|
| additional matter content (ppm) | 0 | $20\left(\frac{B}{B+Si}\right)$ |
| residual potential Vr (V) | | 110 |
| adhesivity to substrate | | x |

TABLE 30

| (Comparative Example 2) | CTL | CGL |
|---|---|---|
| $C_2H_4$ (sccm) | 10 | — |
| $H_2$ (sccm) | 100 | 210 |
| $B_2H_6/C_2H_4$ (sccm) | 0 | — |
| $SiH_4$ (sccm) | — | 90 |
| $PH_3/C_2H_4$ (ppm) | — | — |
| $B_2H_6/SiH_4$ (ppm) | — | 20 |
| Power (W) | 200 | 10 |
| inner pressure of reactor (Torr) | 0.5 | 1.0 |
| direct current (v) | +400 | — |
| time | 10 (hour) | 40 (minute) |
| thickness of layer (μm) | 7 | 0.5 |
| hydrogen content $= \frac{H}{\text{all atoms}}$ (atomic %) | 40 | — |
| $V_0$ (V) | | +400 |
| $E_{\frac{1}{2}}$ (lux · sec) | | >10 |
| additional matter content (ppm) | 0 | $20\left(\frac{B}{B+Si}\right)$ |
| residual potential Vr (V) | | 250 |
| adhesivity to substrate | | x |

TABLE 31

| (Comparative Example 3) | CTL | CGL |
|---|---|---|
| $C_2H_4$ (sccm) | 10 | — |
| $B_2H_6 + H_2$ (sccm) | 100 | 210 |
| $B_2H_6/C_2H_4$ (sccm) | 30000 | — |
| $SiH_4$ (sccm) | — | 90 |
| $PH_3/C_2H_4$ (ppm) | — | — |
| $B_2H_6/SiH_4$ (ppm) | — | 20 |
| Power (W) | 200 | 10 |
| inner pressure of reactor (Torr) | 0.5 | 1.0 |
| direct current (v) | +400 | — |
| time | 10 (hour) | 40 (minute) |
| thickness of layer (μm) | 7 | 0.5 |
| hydrogen content $= \frac{H}{\text{all atoms}}$ (atomic %) | 40 | — |
| $V_0$ (V) | | +50 |
| $E_{\frac{1}{2}}$ (lux · sec) | | 7.3 |
| additional matter content (ppm) | $30000\left(\frac{B}{C+B}\right)$ | $20\left(\frac{B}{Si+B}\right)$ |

TABLE 31-continued

| (Comparative Example 3) | CTL | CGL |
|---|---|---|
| residual potential Vr (V) | | 20 |
| adhesivity to substrate | | ○ |

TABLE 32

| (Comparative Example 4) | CTL | CGL |
|---|---|---|
| $C_2H_4$ (sccm) | 10 | — |
| $H_2$ (sccm) | 100 | 210 |
| $B_2H_6/C_2H_4$ (sccm) | — | — |
| $SiH_4$ (sccm) | — | 90 |
| $PH_3/C_2H_4$ (ppm) | 0 | — |
| $B_2H_6/SiH_4$ (ppm) | — | 0 |
| Power (W) | 200 | 10 |
| inner pressure of reactor (Torr) | 0.5 | 1.0 |
| direct current (v) | +400 | — |
| time | 10 (hour) | 40 (minute) |
| thickness of layer (μm) | 7 | 0.5 |
| hydrogen content $= \frac{H}{\text{all atoms}}$ (atomic %) | 40 | — |
| $V_0$ (V) | | +400 |
| $E_{\frac{1}{2}}$ (lux · sec) | | >10 |
| additional matter content (ppm) | 0 | 0 |
| residual potential Vr (V) | | −250 |
| adhesivity to substrate | | x |

TABLE 33

| (Comparative Example 5) | CTL | CGL |
|---|---|---|
| $C_2H_4$ (sccm) | 10 | — |
| $H_2$ (sccm) | 0 | 210 |
| $B_2H_6/C_2H_4$ (sccm) | 0 | — |
| $SiH_4$ (sccm) | — | 90 |
| $PH_3/C_2H_4$ (ppm) | 30000 | — |
| $B_2H_6/SiH_4$ (ppm) | — | 0 |
| Power (W) | 200 | 10 |
| inner pressure of reactor (Torr) | 0.5 | 1.0 |
| direct current (v) | +400 | — |
| time | 10 (hour) | 40 (minute) |
| thickness of layer (μm) | 7 | 0.5 |
| hydrogen content $= \frac{H}{\text{all atoms}}$ (atomic %) | 40 | — |
| $V_0$ (V) | | −30 |
| $E_{\frac{1}{2}}$ (lux · sec) | | >10 |
| additional matter content (ppm) | $30000\left(\frac{P}{C+P}\right)$ | 0 |
| residual potential Vr (V) | | −20 |
| adhesivity to substrate | | ○ |

COMPARATIVE EXAMPLE 6

An a-Si photosensitive member having an a-Si charge generating layer of 5 μm thick was prepared according to the same manner as the process (II) in Comparative example 2, but the process (I) (preparation of C:H charge transporting layer) was omitted.

The obtained photosensitive member had an initial surface potential (Vo) of −100 V and $E_{\frac{1}{2}}$ of 0.7 lux.sec., but had an insufficient charging capacity at a positive polarity and gave an unclear copy.

Residual potential and stability for repetition are unacceptable and adhesive properties of the substrate with the above layer are also unacceptable.

It is understood that a charge transporting layer of the invention contributes to the improvement of a charging capacity and is excellent in a charge transporting property.

COMPARATIVE EXAMPLE 7

A photosensitive member was prepared by coating a polyethylene layer formed by the conventional organic polymerization on a substrate instead of the C:H layer prepared at the process (I) of Comparative example 2 and then applying the process (II) on the coated layer in the same condition as in Comparative example 2 to produce an a-Si layer (1 μm). The hydrogen content is 67 atm.% and initial surface potential is −600 V but the reduction of potential by exposure did not reach to even a half value of the initial one. Residual potential and stability for repetition are unacceptable.

COMPARATIVE EXAMPLE 8

Figure 16:
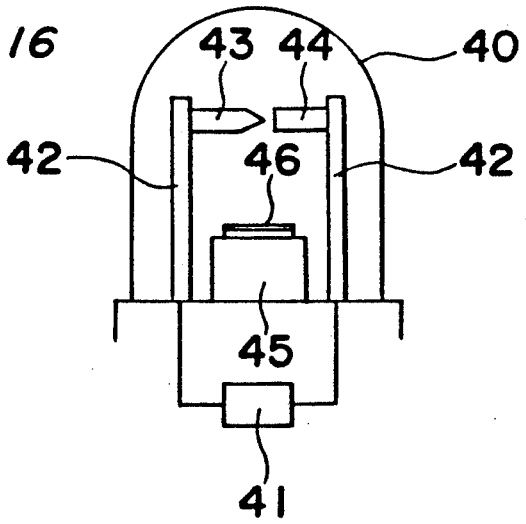
FIG. 16 shows an apparatus for arc deposition used in a comparative example.

A carbon layer not containing hydrogen was prepared using an arc discharge vapor deposition apparatus as shown in FIG. 16, in which an electrode supporting rods (42) and (44) connected with an power source (41) were equipped in a vacuum container (40), an Al substrate (46) was placed on a supporter for a substrate (45) having carbon electrodes (43) and (44), and an arc discharge was generated under a container pressure of $10^{-5}$ Torr and an electric current to carbon electrode of 50 Å to deposit a carbon layer not containing hydrogen in a thickness of 5 μm on the Al substrate.

The obtained carbon layer had a resistance of less than $10^8$ Ω.cm not to be used as a photosensitive member for electrophotography.

When an a-Si layer was formed on the carbon layer under the same condition as in Comparative example 1, the a-Si layer (1 μm) was exfoliated from the carbon layer.

What is claimed is:

1. A photosensitive member comprising:
an electrically conductive substrate;
a charge generating layer; and
a charge transporting layer of amorphous carbon containing hydrogen, said charge transporting layer including less than about 20000 ppm of an impurity element in Group IIIA or VA of the Periodic Table based on the amount of carbon and elements in Group III A or VA, to said charge transporting layer having a relative dielectic constant of about 2.0 to 6.0, an optical energy gap of about 1.5 to 3.0 eV and a thickness of from about 5 to 50 μm, and said hydrogen being contained in an amount of about 0.1 to 67 atomic % based on the amount of all atoms contained in said charge transporting layer.

2. A photosensitive member as claimed in claim 1 wherein said charge transporting layer contains the element in Group III A to make the layer in the vicinity of the substrate P-type and the layer in the vicinity of the surface of said photosensitive member N-type for positive charging.

3. A photosensitive member as claimed in claim 2 wherein said impurity element in Group III A of the Periodic Table is preferably contained in an amount of 3 to 1000 ppm based on the amount of carbon and elements in Group III A.

4. A photosensitive member as claimed in claim 3 wherein said impurity element in Group III A is boron.

5. A photosensitive member as claimed in claim 1 wherein said charge transporting layer contains the element in Group VA to make the layer in the vicinity of the substrate N-type and the layer in the vicinity of the surface of said photosensitive member P-type for negative charging.

6. A photosensitive member as claimed in claim 5 wherein said impurity element in Group VA of the Periodic Table is preferably contained in an amount of 1 to 1000 ppm based on the amount of carbon and elements in Group VA.

7. A photosensitive member as claimed in claim 6 wherein said impurity element in Group VA is phosphorous.

8. A photosensitive member comprising:
an electrically conductive substrate;
a charge generating layer; and
a charge transporting layer of amorphous carbon containing hydrogen, said charge transporting layer including less than about 20000 ppm of an impurity element in Group III A so that the layer in the vicinity of the substrate is controlled to be P-type while the layer in the vicinity of the surface of said photosensitive member is controlled to be N-type for positive charging, said charge transporting layer having a relative dielectric constant of 2.0 to 6.0, of about 1.5 to 3.0 eV and a thickness of about 5 to 50 μm, and essentially no photosensitivity and said hydrogen being contained in an amount of 0.1 to 67 atomic % based on the amount of all atoms contained in said charge transporting layer.

9. A photosensitive member as claimed in claim 8 wherein said impurity element in Group III A is boron.

10. A photosensitive member comprising:
an electrically conductive substrate;
a charge generating layer; and
a charge transporting layer of amorphous material containing carbon and hydrogen, said charge transporting layer including less than about 20000 ppm of an impurity element in Group VA so that the layer in the vicinity of the substrate is controlled to be N-type while the layer in the vicinity of the surface of said photosensitive member is controlled to be P-type for negative charging, said charge transporting layer having a relative dielectric constant of 2.0 to 6.0, of about 1.5 to 3.0 eV and a thickness of about 5 to 50 μm and essentially no photosensitivity, and said hydrogen being contained in an amount of 0.1 to 67 atomic % based on the amount of all atoms contained in said charge transporting layer.

11. A photosensitive member as claimed in claim 10 wherein said impurity element in Group VA is phosphorous.

12. A photosensitive member as claimed in claim 1, wherein said charge transporting layer has a thickness of from about 7 to 20 μm.

13. A photosensitive member as claimed in claim 1, wherein said charge transporting layer has hydrogen in an amount of from 1 to 60 atomic % based on the amount of all atoms contained in said charge transporting layer.

14. A photosensitive member as claimed in claim 1, wherein said charge transporting layer has hydrogen in an amount of from 30 to 60 atomic % based on the amount of all atoms contained in said charge transporting layer.

15. A photosensitive member as claimed in claim 1, wherein said charge transporting layer has hydrogen in an amount of from 40 to 58 atomic % based on the amount of all atoms contained in said charge transporting layer.

* * * * *

UNITED STATES PATENT AND TRADEMARK OFFICE

CERTIFICATE OF CORRECTION

PATENT NO. : 5,166,018

DATED : November 24, 1992

INVENTOR(S) : Shuji Iino et al.

It is certified that error appears in the above-identified patent and that said Letters Patent is hereby corrected as shown below: The cover page of the patent should read:

[45] Date of Patent: * November 24, 1992

[*] Notice: The portion of the term of this patent subsequent to May 3, 2005 has been disclaimed.

Signed and Sealed this

Ninth Day of November, 1993

Bruce Lehman

*Attest:*

BRUCE LEHMAN

*Attesting Officer*

*Commissioner of Patents and Trademarks*